US005515561A

United States Patent [19]

Suggitt et al.

[11] Patent Number: 5,515,561

[45] Date of Patent: May 14, 1996

[54] ARTICULATING BED

[75] Inventors: Robert W. Suggitt, Newbury Park, Calif.; Michael C. Jillings, Chilliwack, Canada

[73] Assignee: ProBed Medical Technologies, Inc., Sardis, Canada

[21] Appl. No.: 235,951

[22] Filed: Apr. 29, 1994

Related U.S. Application Data

[63] Continuation-in-part of Ser. No. 885,621, May 19, 1992, abandoned.

[51] Int. Cl.[6] ..... A61G 7/008

[52] U.S. Cl. ..... 5/607; 5/600

[58] Field of Search ..... 5/607, 609, 613, 5/614, 600

[56] References Cited

U.S. PATENT DOCUMENTS

| | | | |
|---|---|---|---|
| 4,375,706 | 3/1983 | Finnhult | 5/607 |
| 5,125,122 | 6/1992 | Chen | 5/618 |

FOREIGN PATENT DOCUMENTS

| | | | |
|---|---|---|---|
| 86832 | 2/1959 | Denmark | 5/613 |
| WO86/03663 | 7/1986 | WIPO | 5/465 |
| WO91/07157 | 5/1991 | WIPO | 5/613 |

*Primary Examiner*—Alexander Grosz

*Attorney, Agent, or Firm*—Merchant, Gould, Smith, Edell, Welter & Schmidt

[57] ABSTRACT

An articulated bed comprising: a central platen comprising a headboard end, a footboard end, a first side platen edge and a second side platen edge; a headboard frame pivotally connected to the headboard end of the central platen at a headboard frame pivot point with a central platen headboard bar linkage; a footboard frame pivotally connected to the footboard end of the central platen at a footboard frame pivot point with a central platen footboard bar linkage; a first side platen hinged to the first side platen edge of the central platen, connected to the headboard frame with a first side platen headboard bar linkage and connected to the footboard frame with a first side platen footboard bar linkage; a second side platen hinged to second side platen edge of the central platen, connected to the headboard frame with a second side platen headboard bar linkage and connected to the footboard frame with a second side platen footboard bar linkage; and means for articulating at least one of the central platen headboard bar linkage and the central platen footboard bar linkage.

8 Claims, 23 Drawing Sheets

ARTICULATING BED

CROSS REFERENCE TO RELATED APPLICATIONS

This application is a continuation-in-part of U.S. Ser. No. 07/885,621, now abandoned, filed on May 19, 1992, the entire contents of which are hereby expressly incorporated by reference into the present application.

FIELD OF THE INVENTION

The present invention relates to various apparatus and methods for rotating bedridden individuals, and more particularly to an improved bed utilizing a mechanical method of manipulating a multiple part platen, articulating under the patient to mechanically and automatically rotate the bedridden person from side to side to eliminate prolonged tissue compression and enhance cardiovascular activity throughout the body of the individual.

BACKGROUND OF THE INVENTION

According to traditional, prior art methods of turning people, most people are physically lifted and turned by hand, and propped up with pillows, or rotated in special beds which require the patient to be strapped into the device (i.e., the Striker Bed). Manual turning is risky to the care giver, frequently resulting in lower back stress or other damage. In addition, due to hospital overloading, the turning is often delayed, or not accomplished in a timely manner, leading to problems to the bedridden patient.

Other systems currently in use include waterbeds; problems are: 1. do not provide gross body motion; 2. the patients may not be able to tolerate the buoyant rocking motion of the bed; 3. the waterbed is notoriously difficult for patient transfer (to and from the bed); 4. a waterbed is extremely heavy; 5. waterbeds cannot provide relief for thin or obese patients, (common complications of quadriplegia); 6. small areas of skin covering bony protuberances can still be compromised because of the tension in the surface of the water filled mattress.

Another common system is the alternating air pump mattress, consisting of parallel rows of pliant plastic tubes attached along the edges of the mattress. The tubes are alternated in their connection so that every other tube is pressurized and then deflated in timed cycle. This device will provide some relief from pressure sores. Problems: 1. does not provide gross body motion; 2. relies on line power for operation; 3. not very effective for thin patients; and 4. not comfortable.

The third system is flotation. This consists of a very expensive system of pumping air, alternating the inflation of a series of porous sacs upon which the person is supported. Problems: 1. does not provide gross body motion; 2. some components are consumable; 3. relies on line power for operation; 4. exceptionally expensive to operate and maintain, and difficult to operate.

SUMMARY OF THE INVENTION

The present invention is directed to an articulated bed comprising: a central platen comprising a headboard end, a footboard end, a first side platen edge and a second side platen edge; a headboard frame pivotally connected to the headboard end of the central platen at a headboard frame pivot point with a central platen headboard bar linkage; a footboard frame pivotally connected to the footboard end of the central platen at a footboard frame pivot point with a central platen footboard bar linkage; a first side platen hinged to the first side platen edge of the central platen, connected to the headboard frame with a first side platen headboard bar linkage and connected to the footboard frame with a first side platen footboard bar linkage; a second side platen hinged to second side platen edge of the central platen, connected to the headboard frame with a second side platen headboard bar linkage and connected to the footboard frame with a second side platen footboard bar linkage; and means for articulating at least one of the central platen headboard bar linkage and the central platen footboard bar linkage.

The present invention solves all of the problems found in the previous devices discussed above, and the benefits are as follows:

- provides gross body motion by turning the patient slowly and safely;
- provides a rigid surface for ease of transfer;
- may be alternating current or battery powered;
- light frame can be fitted with casters for mobility;
- is equally effective with normal, thin or obese patients;
- is simple to operate on an automatic or self-directed schedule;
- multiple options include, head raiser, foot raiser, built in bed pan;
- due to built in rigidity, and rotating side platens, no side rails are required, therefore no pinch point between the rotating bed and stationary longitudinal parts; and
- bed can be fitted with a mechanism for varying platen elevation to suit care giver.

Other objects, advantages and features of the present invention will be more readily appreciated and understood when considered in conjunction with the following detailed description and drawings.

BRIEF DESCRIPTION OF THE DRAWINGS

These and other aspects of the invention are apparent from the purely exemplary, and therefore not restrictive, embodiments illustrated in the following drawings, in which.

DESCRIPTION OF THE PREFERRED EMBODIMENTS

Figure 1:
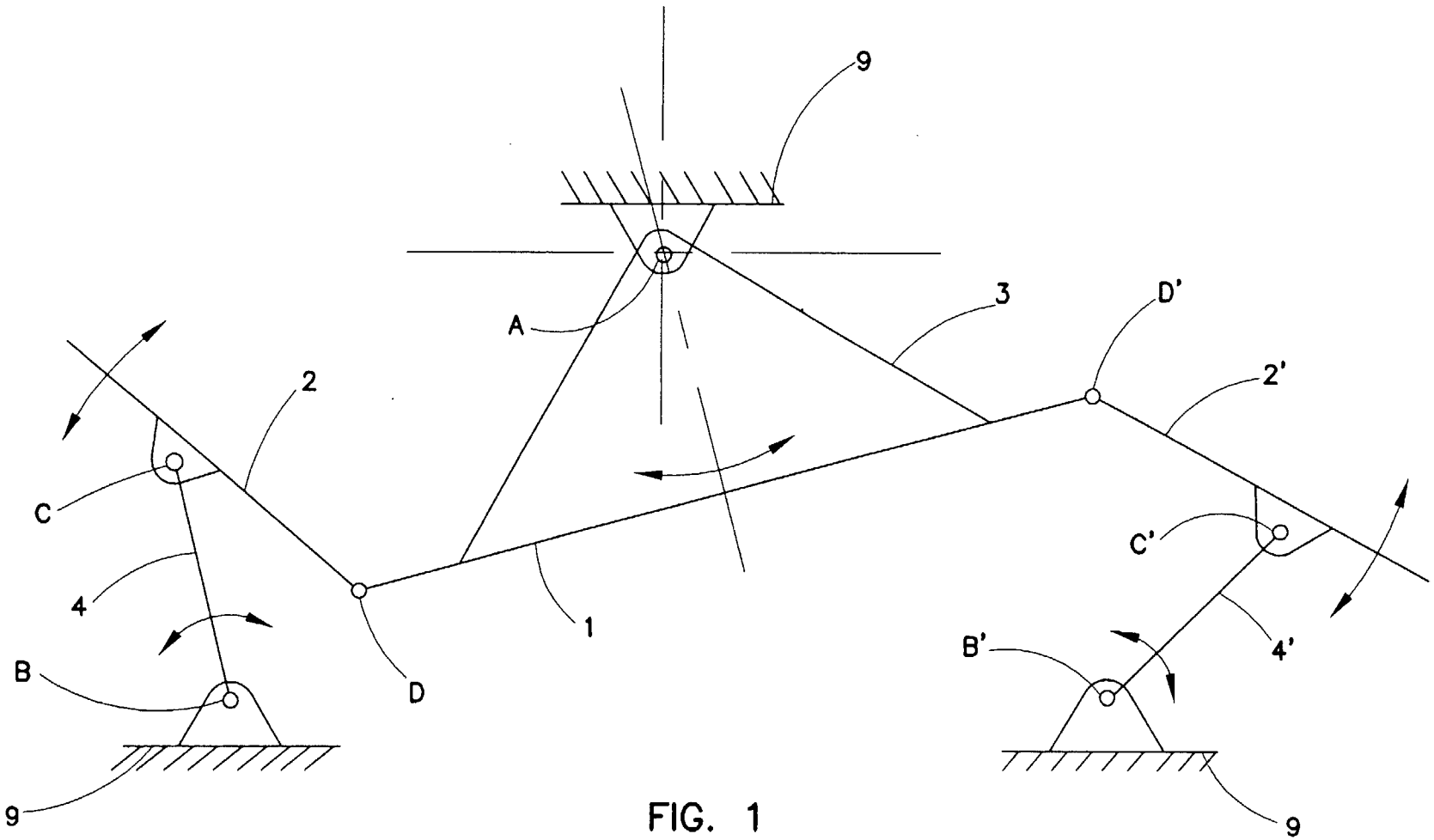
FIG. 1 illustrates a simplified line diagram end view of the mattress support mechanism assembled in accordance with the present invention to simply demonstrate the action of the individual members of the mechanism, the mattress support mechanism is shown rotated in an angle off of level.

All the disclosed embodiments can be made using conventional compounds and procedures without undue experimentation. All the disclosed embodiments are useful.

The invention and various advantageous details thereof are explained more fully below with reference to exemplary embodiments and with the aid of the drawings. In each of the drawings, parts the same as, or equivalent to each other, are referenced correspondingly.

A bed to enhance the comfort and health of bedridden persons, both at home and in hospital, with an articulating mattress surface especially designed to automatically and safely reposition the bedridden person so as to optimize health and independence, including the virtual elimination of bed sores (decubitus ulcers) and other tissue and organ degeneration. This is accomplished with an articulated platen (mattress support) which is a rigid, stiffened surface composed of three longitudinal parts supported and attached to longitudinal structural members. These platen parts and their respective structural members are connected together by two longitudinal hinges.

Complex angular configurations are achieved by three bar linkages connected to each end of the platens, or their attached structural members. One bar link is attached to each platen part end. Each set of three bar linkages are hinged in such a way that a pivoted center section causes the outer platen parts into a predetermined angular relationship with the center platen. The three bar linkages at each end of the longitudinal platen parts are fixed to rigid frames. An actuator causes rotation of the central platen which in turn causes relative rotation of the outside platens in order to support the body of the person when rotated from side to side. The design is such that the steeper the angle, the greater the support provided by the outer platen parts. The center of rotation of the central platen is the approximate center line of the persons body lying centered on a mattress supported by the central platen. Therefore, an additional benefit is that the person can be in traction while being rotated. In this way, minimal force is required to rotate the body and rotation can be made to occur quickly or extremely slowly at the person's discretion, with the use of an optional computerized controller. There is little or no sensation of motion to the body from being moved by this mechanism. There is also no shear force applied to the skin because the body does not translate relative to the mattress during motion. This rotation can be controlled with a programmable microprocessor based controller and associated custom software or with the use of a single switch interface.

The present invention relates to an improved bed, and more particularly to a bed which is adapted for use with bedridden persons who require turning to minimize prolonged tissue compression (i.e. paraplegics, quadriplegics, MS patients, certain burn patients, or any other persons who are unable to turn themselves for any reason). Turning of these individuals is often required for the prevention of decubitus ulcers (bedsores), for the enhancement of the circulatory systems, respiratory system, and the internal organs. This device was developed with a sensitivity towards human needs, specifically for those people leaving the critical care environment and reintegrating with society after catastrophic injury. The needs of the average quadriplegic in a home setting can be a tremendous physical and emotional burden on the family. As a result of their injuries or disabilities, they are susceptible to a lot of problems specific to the enforced sedentary life-style, not the least of which is decubitus ulcers. Decubitus ulcers is a condition in which the skin dies as a result of being denied blood flow (prolonged tissue compression causes this condition). This dead tissue is sloughed off, leaving a hole (in the worst cases), and creates an ideal path for opportunistic infection. An able-bodied persons will move periodically while sleeping, and this random motion prevents the skin in any one area from breaking down. This invention attempts to mimic the body's natural nocturnal motion by major repositioning (mass body movement), sufficient to redistribute skin loading. The motion is timed, rather than random, and the rate is adjustable to permit the accommodation of a wide variety of sleeping patterns. The test units were used by quadriplegics who would otherwise have required extended hospital care or constant attention at home. Due to the motions provided by this articulating bed, these bedridden persons have incurred fewer skin problems and other related complications such as swelling of limbs, and urinary and cardiovascular infections. Hospitals will apply this technology to improve patient care, reduce care cost and lower the incidence of back problems in their nursing staff.

A bed constructed according to the present invention is generally described as being comprised of an articulated platen which is defined here as a rigid stiffened surface. This surface acts to support a mattress. The mattress may be in several parts as shown in FIGS. 1, 2, 3, 3A, and 4, items numbered 15, 16 and 16 or as a single unit. The articulated platen is constructed of three parts 2, 2' and 3 and is capable of continuous, complex, controllable configurations.

The platen parts 1, 2 and 2' are connected to two longitudinal hinges D and D' which are connected to the inner edges of 2 and 2', and the outer edges of 1. D and D' are the platen articulation points.

The complex configurations are achieved by three connected bar linkages 3, 4 and 4' hinged in such a way that a pivoted center platen section 1 causes the bar linkages 4 and 4' into a predetermined angular relationship with the center platen section 1, which in turn control the position of platen parts 4 and 4'.

Articulation points A, B and B' are rigidly fixed to a rectangular frame 9. An actuator 13 causes rotation of bar linkage 3 which in turn causes relative rotation of bar linkages 4 and 4', and platen parts 2 and 2' about points B and B', and C, C' respectively. Rotational points C, C' and D, D' will translate in space. The rotational point A is the approximate center line of a body 19 lying centered on a mattress supported by platen part 1. In this way, minimal force is required to rotate the body and rotation can be made to occur rapidly or extremely slowly through the electronic controlling mechanism. There is little or no sensation of motion to the body from being moved by this mechanism. There is also no shearing force applied to the skin because the body does not translate relative to the mattress during motion. As platen part 1-D' continues to rotate clockwise, platen part 2' continues to rotate counterclockwise until a 90 degree angle forms at articulation point D' and platen part 2' and its relative mattress section 16' firmly supports the body at the steepest point of rotation.

Figure 2:
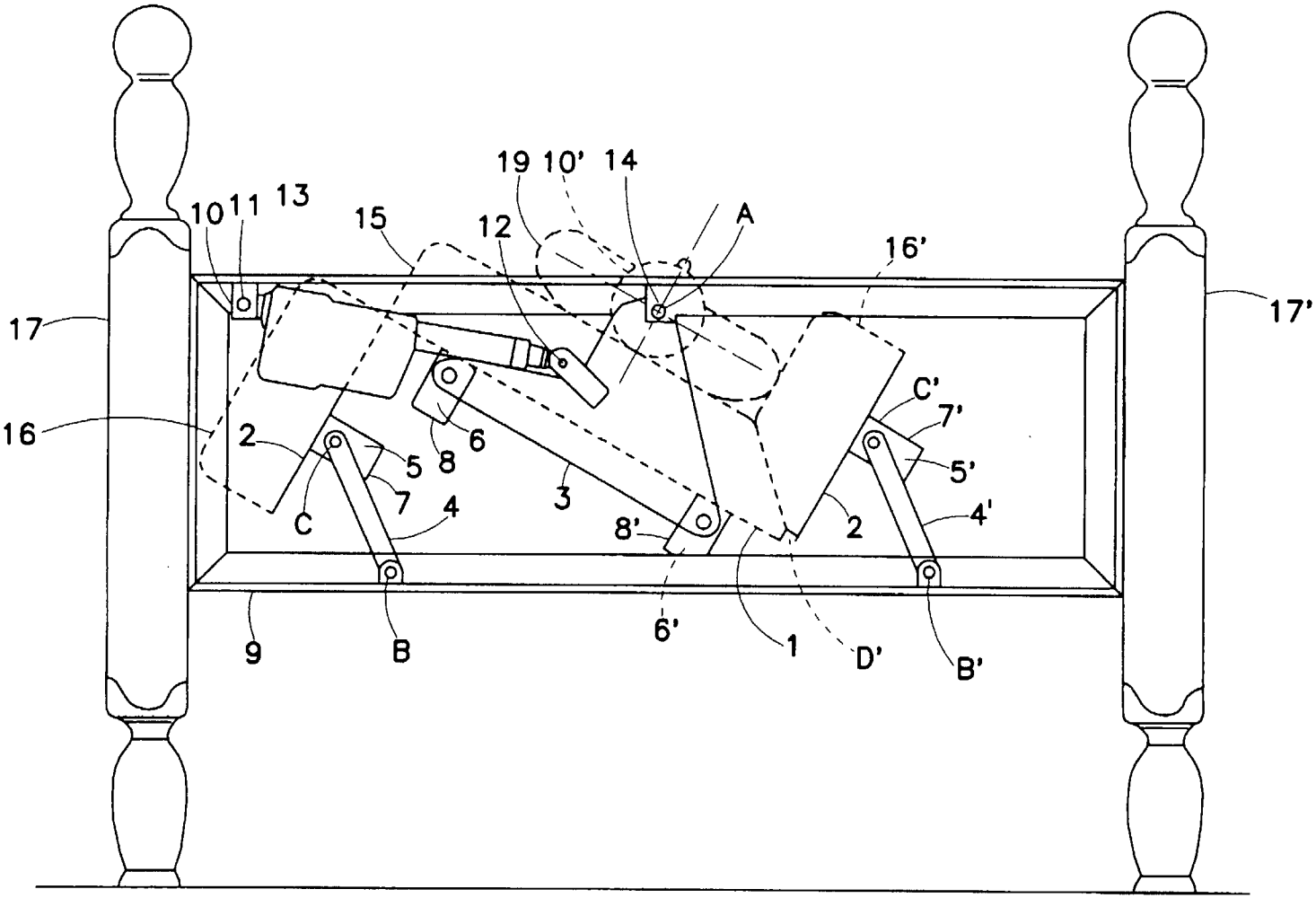
FIG. 2 illustrates a view taken from the end showing the mattress support mechanism rotated clockwise and showing the frame, the platen sections, with their attached support members, a potential actuator, and the three bar linkages.
Figure 5:
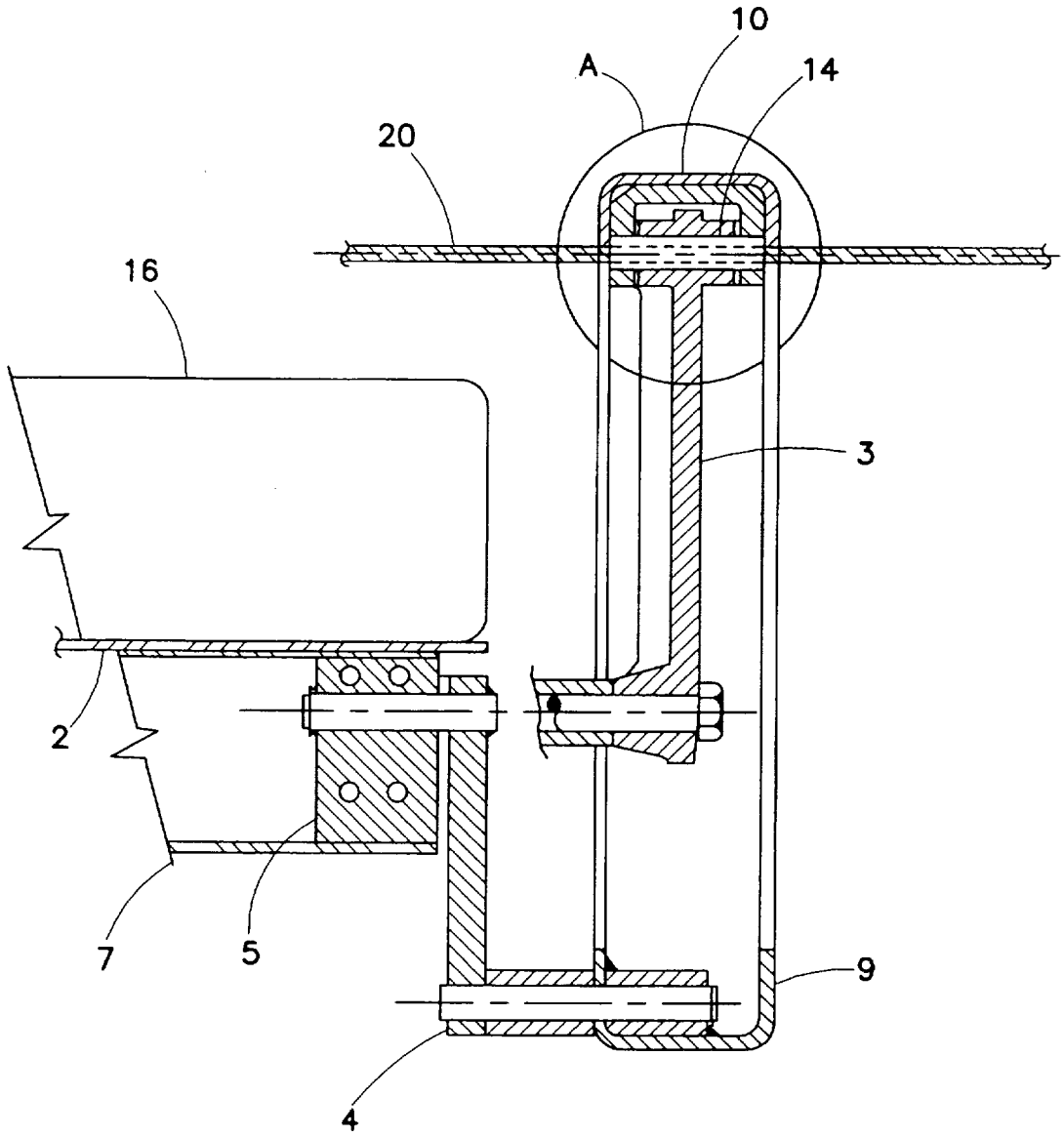
FIG. 5 illustrates a cross section of the articulation point "A" showing the opening for a cable to the patient allowing traction during articulation.

An important consideration in this improved bed design is best shown in FIG. 5, with reference to FIG. 2. A very competent structural section is developed between the various pin jointed sections attached to the three bar linkages 3, 4 and 4', their locked conditions of attachment to the frame 9 (articulation points A, B, and B') and their mechanical attachment to insert blocks 5, 5', 6 and 6', which are firmly anchored into the platen structural members 7, 7', 8 and 8'. This structural arrangement constrains the bed from longitudinal movement eliminating the need for additional, stationary mechanical restraints. The posts 17 are necessary only to obtain comfortable heights for the care giver, and as an attractive complement with matching pieces to cover the headboard and foot board to cover the components and transition the unit into an attractive piece of furniture. The minimum structural integrity is maintained while the platen is level, and in fact the structural integrity of the system increases with increasing rotational angle, as the section modulus increases with increases in rotational angle. The minimum structural integrity is maintained while the platen is level, and options such as the head and leg raiser can be added without affecting this integrity. Since there are no other mechanical constraints required, the big advantage is excellent access of the care giver to the patient, and safety as there are no possible pinch points between dynamic members and stationary members.

Figure 3:
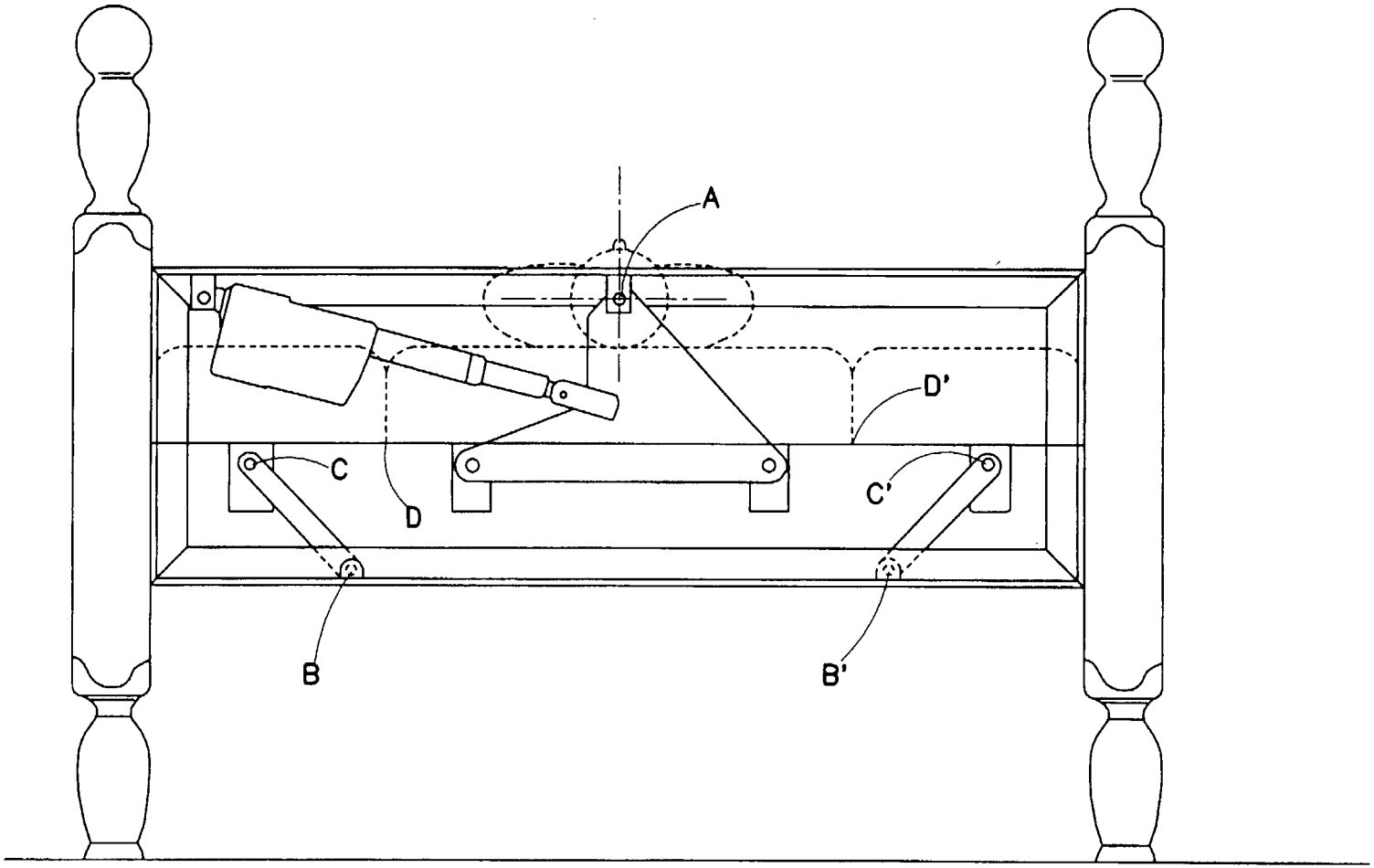
FIG. 3 illustrates a view taken from the end showing the mattress support mechanism rotated to the level or flat position and showing the frame, the platen sections, with their attached support members, a potential actuator, and the three bar linkages.
Figure 3A:
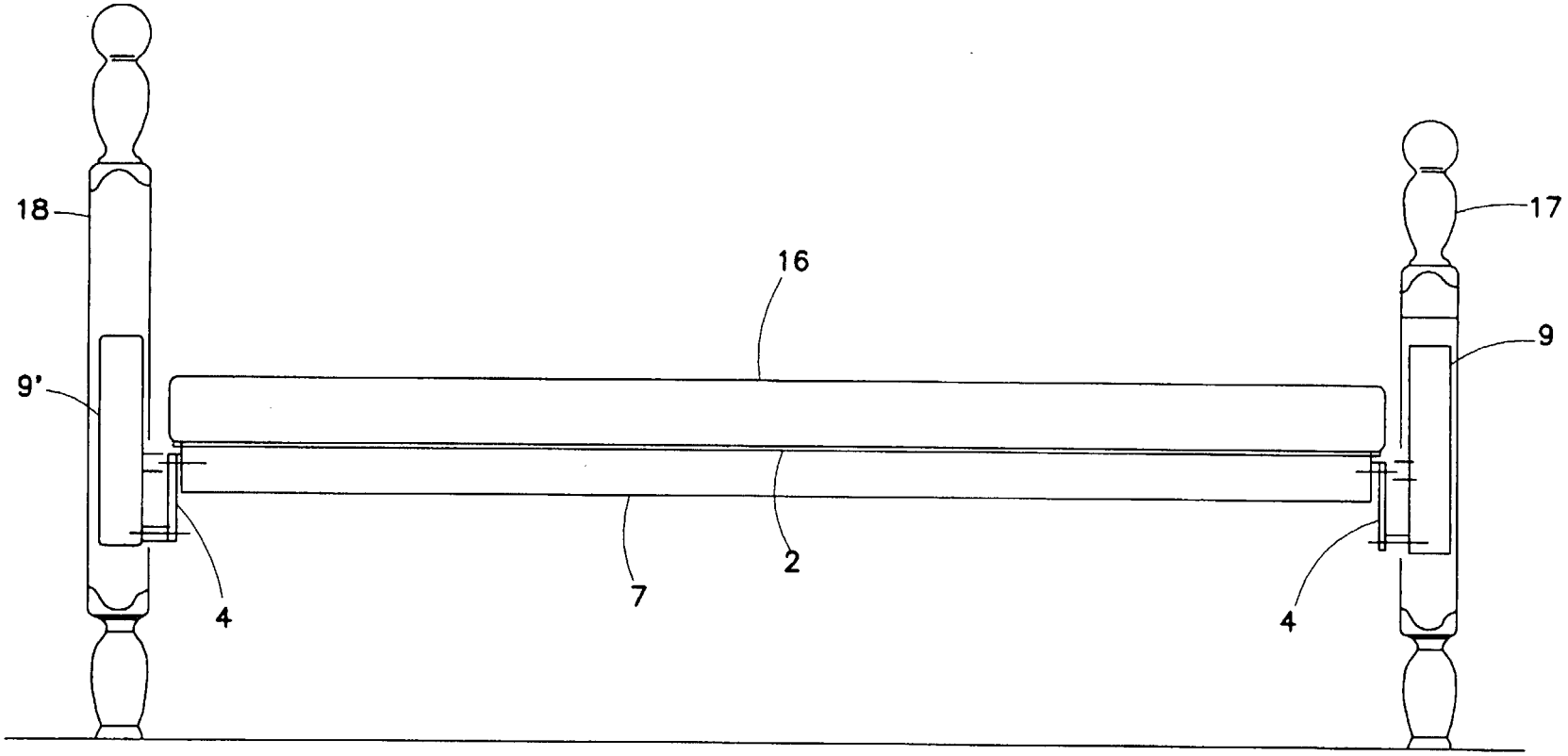
FIG. 3A illustrates a view taken from the right side showing the two end frames, (headboard and foot board), the platen sections in the flat or level position, and the dynamic support members attached to the support platens.
Figure 4:
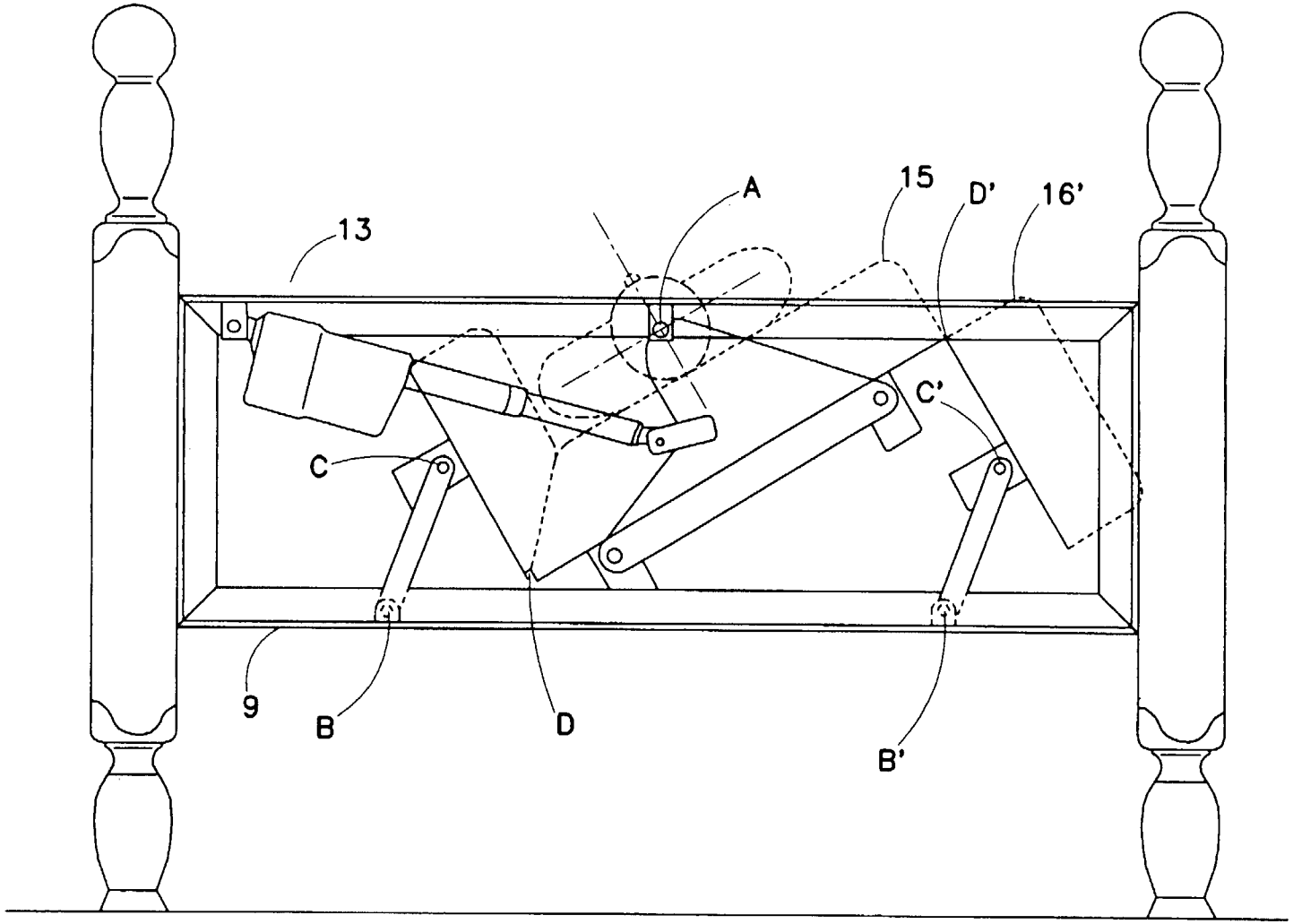
FIG. 4 illustrates a view taken from the end showing the mattress support mechanism rotated counterclockwise and showing the frame, the platen sections, with their attached support members, a potential actuator, and the three bar linkages.

In FIG. 5, with reference to FIGS. 2, 3, and 4, Point A is constructed as follows: Channel frame 9, an extruded clevis section 10 ia anchored to 9, a hollow pin 14 supported by the clevis 10, supports the bar linkage 3 and is constructed of a lubricated bushing material for wear purposes while the bar linkage rotates the platen. As mentioned previously, articulation point A is in line with the patient's body, the hollow pin 14 allows cables to pass through the head frame and foot frame, enabling the patient to be placed in traction while being rotated. The distance initiating at articulation point A and perpendicular to and terminating at the line connecting D and D' may be adjustable to ensure that the patients central body line is in line with A to suit the above mentioned traction situation.

COMPUTER CONTROLS: Electronics

Figure 12:
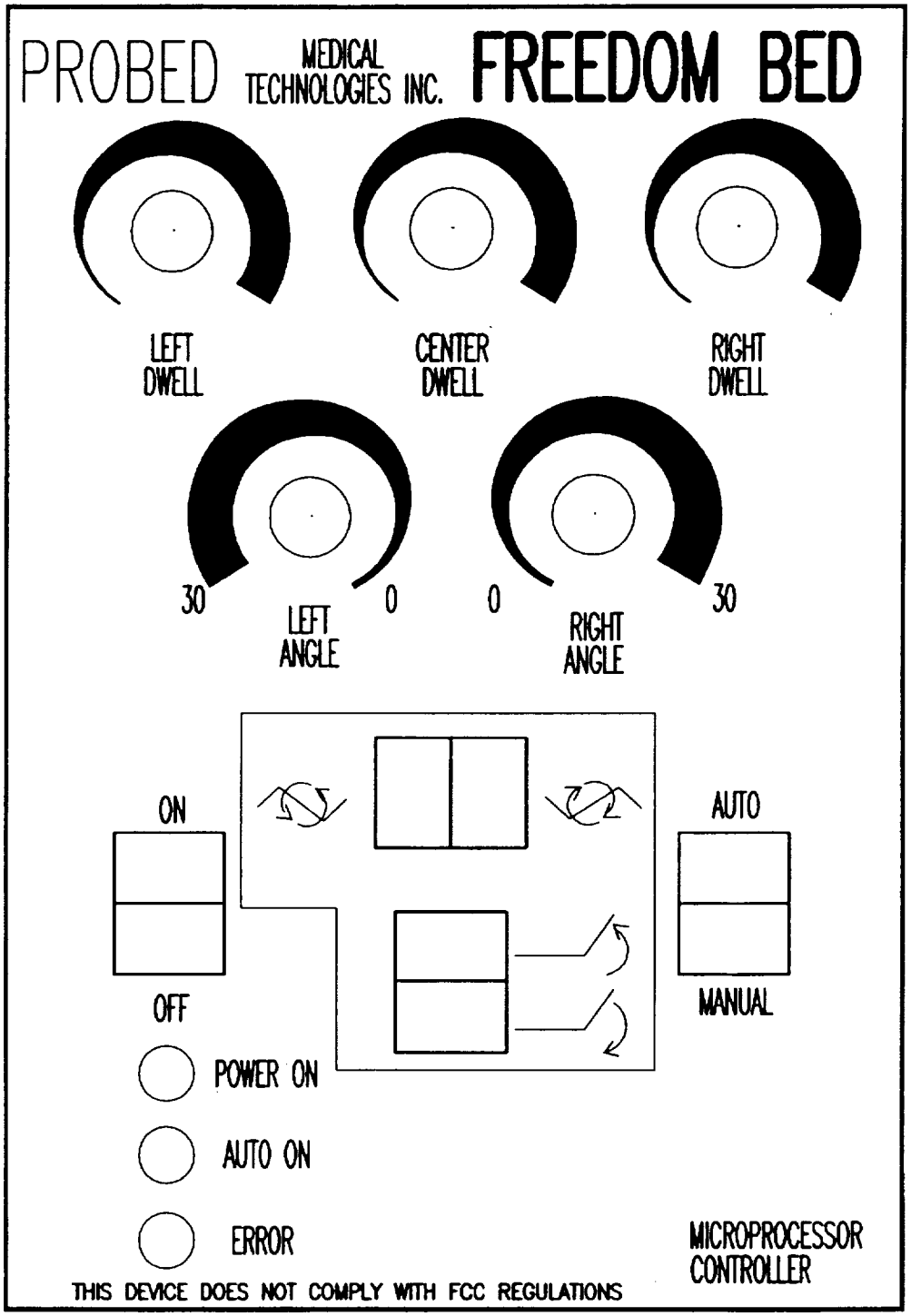
FIG. 12 the layout for the Panel according to the present invention.

This improved articulating bed design utilizes a hybrid digital/analog converter to determine rotational speed and position. The actuator is servo controlled by the microprocessor to allow for constant rotational speed under varying load conditions as the body is turned. Three separate timer FIG. 12 adjustments allow the user to predefine the amount of time spent in any of three possible positions. Setting the timer to "O" dwell time for any one position will cause the controller to move the platen in such a way as to by-pass that position. The acceleration and the maximum speeds are adjustable. Under program control, the platen will "soft" start and "soft" stop to reduce inertial jarring of the user. The end angle in the two side laying positions is adjustable by two controls. When setting the most comfortable angle, the motor will "servo" or move to match the control settings.

AUTOMATIC CONTROL. The controller will determine when to start the rotation based upon the settings of the timers and angle settings. No other input is required as the schedule is repeated until the controller enters an error condition or is turned off.

MANUAL CONTROL. A single switch interface (via a pendant push button, not shown) is integral to the function of the device. Automatic operation can be overridden at any time by a momentary selection of this switch. The user can cause the bed to rotate to the next position or to any intermediate position by activating this control.

PANEL CONTROL. The main control panel FIG. 12 has the three timer and two angle knobs as well as an ON/OFF, AUTO/MANUAL and JOG position switches. An attendant has complete control over the function of the bed through this panel. The pendant push button is connected by a removable connector at this panel. Additionally, any single switch interface including environmental controllers can be attached at this connection for those users unable to use the pendant push button.

Figure 6:
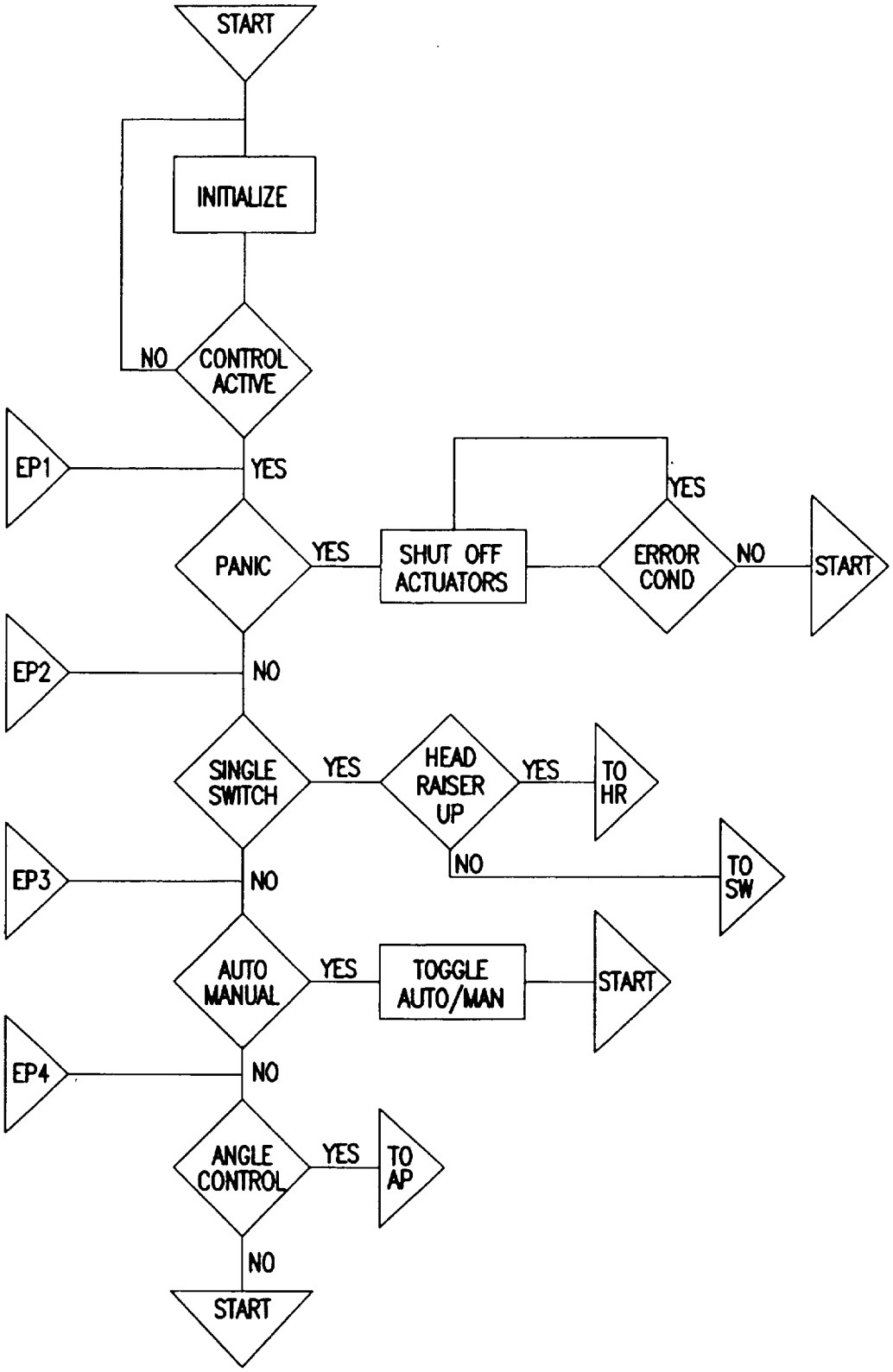
FIG. 6 illustrates a Main Program Routine according to the present invention.
Figure 7:
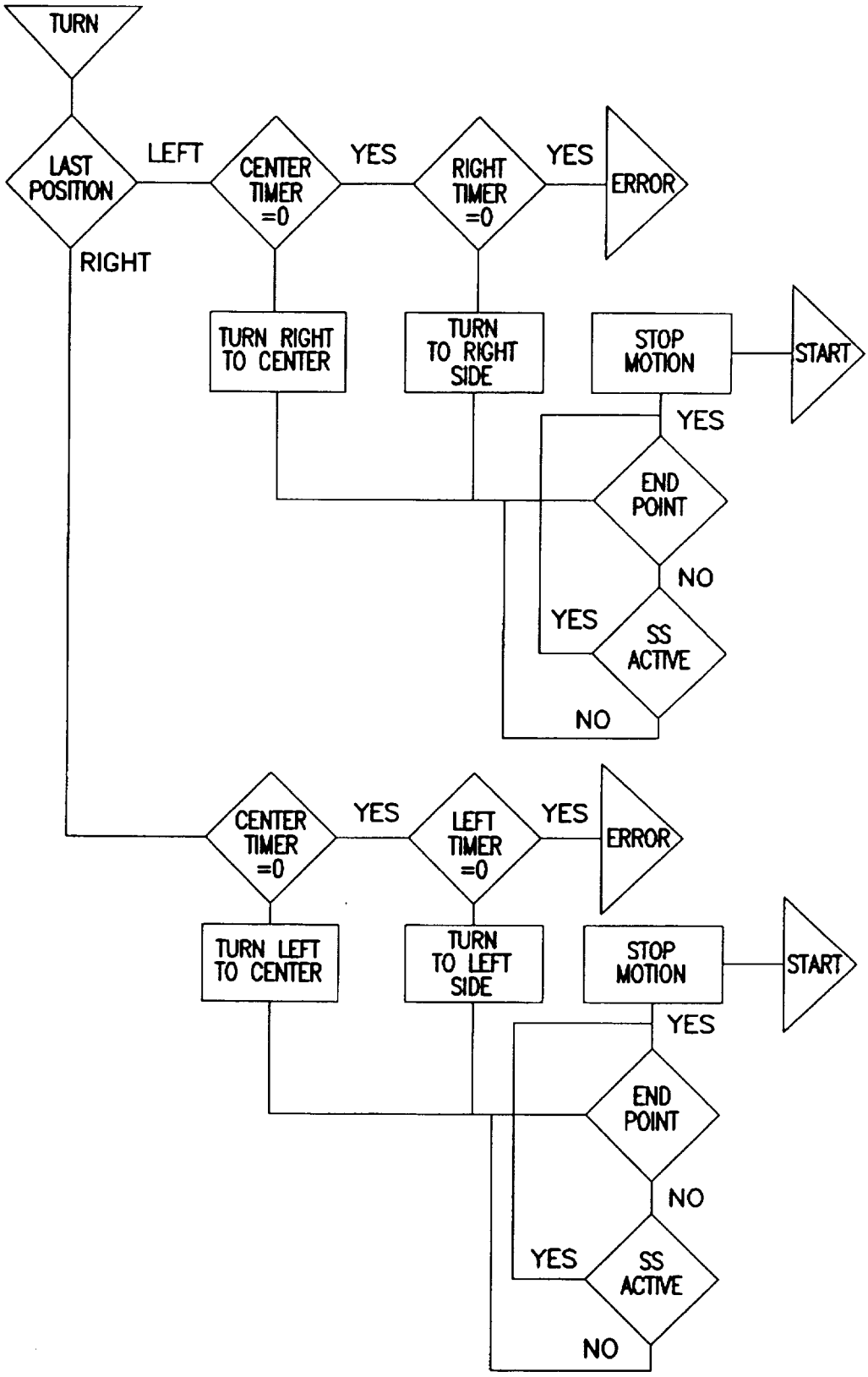
FIG. 7 illustrates a Turn Routine according to the present invention.
Figure 8:
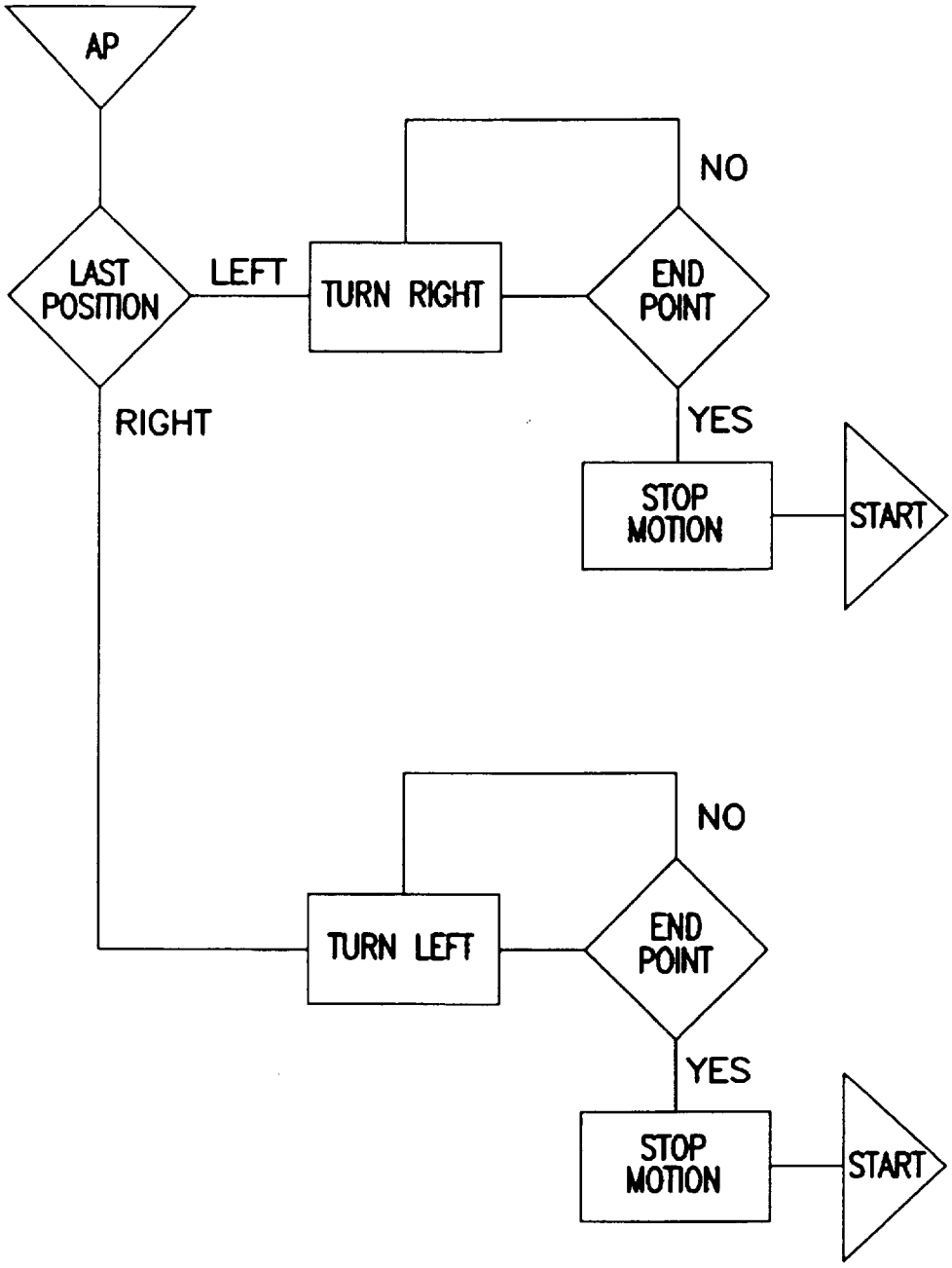
FIG. 8 illustrates an Angle Position Routine (AP Routine) according to the present invention.
Figure 9:
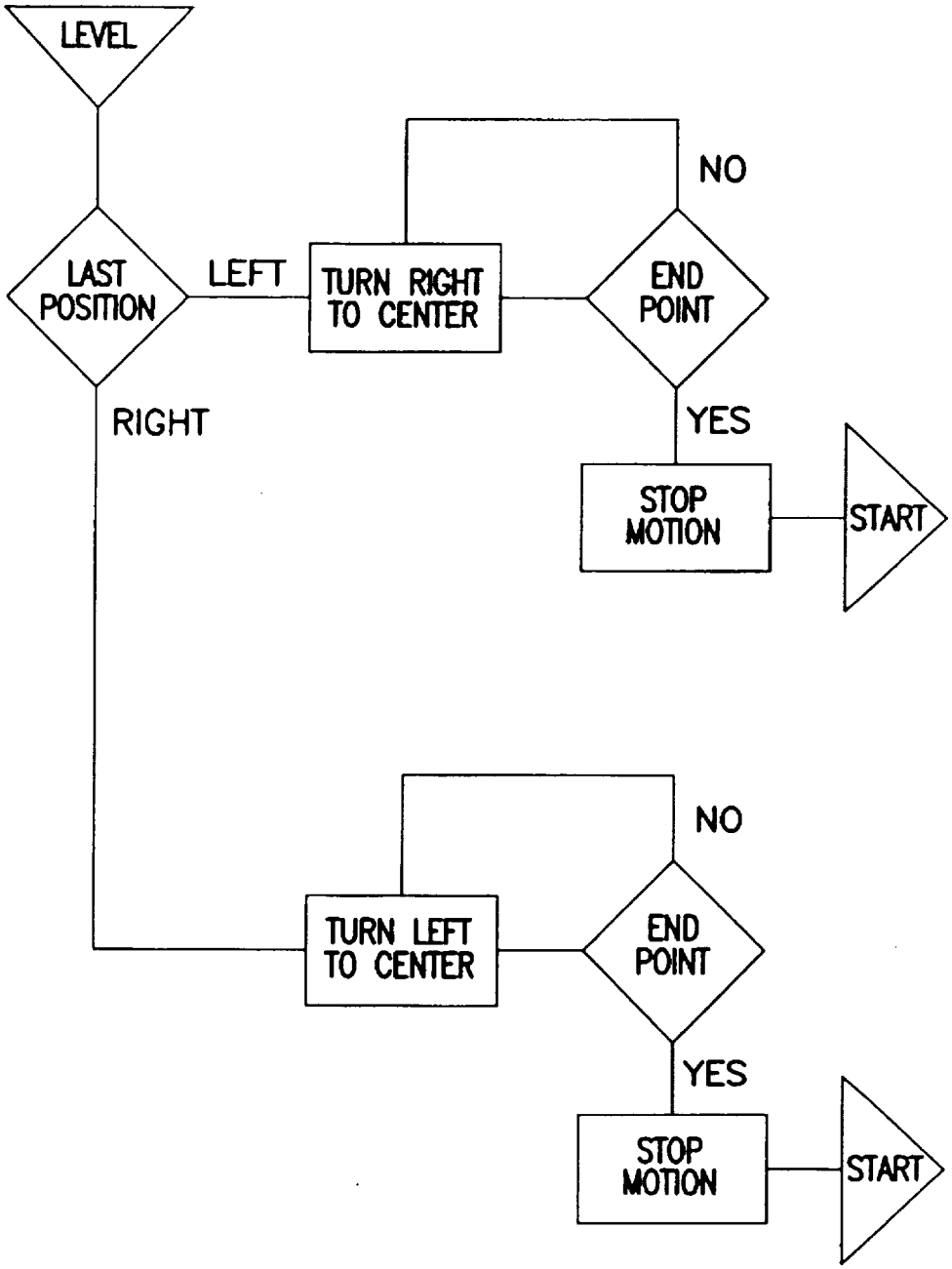
FIG. 9 illustrates a Level Routine according to the present invention.
Figure 10:
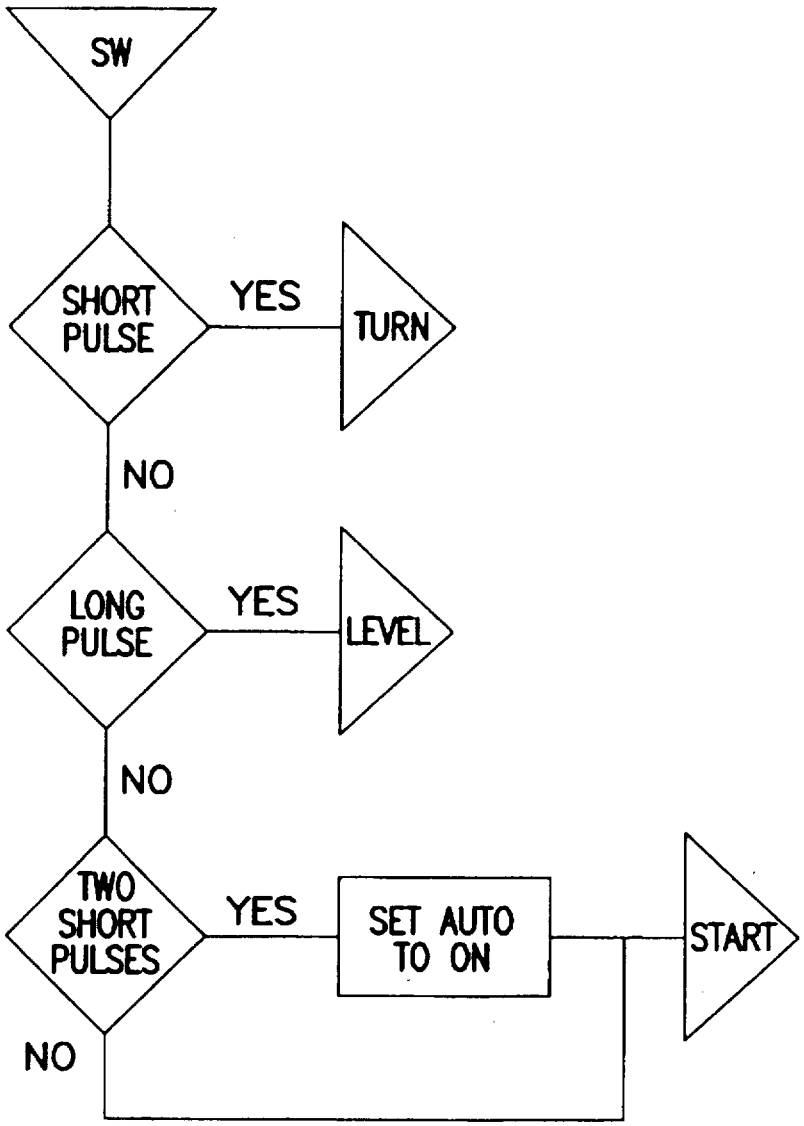
FIG. 10 illustrates a Manual Switch Routine (SW Routine) according to the present invention.
Figure 11:
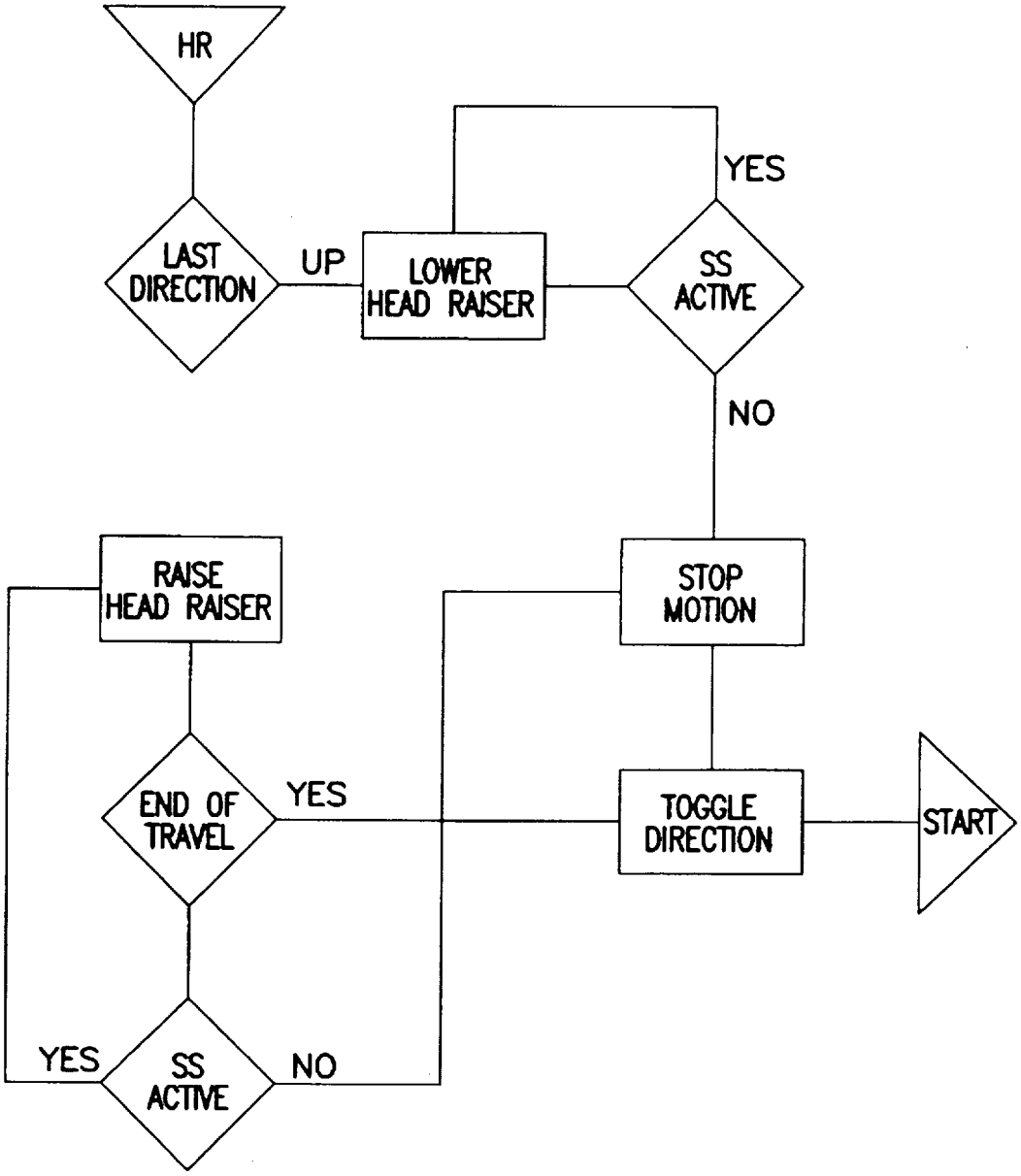
FIG. 11 illustrates a Head raiser Routine (HR Routine) according to the present invention.

Attached are FIGS. 6, 7, 8, 9, 10, and 11, which show in block form electronic routines for the following: FIG. 6 Main Program, FIG. 7 Turn Routine, FIG. 8 Angle Position Routine (AP Routine), FIG. 9 Level Routine, FIG. 10 Manual Switch Routine (SW Routine), and FIG. 11 Head raiser Routine (HR Routine). Accordingly, there has been disclosed a novel and improved bed, this ARTICULATING BED FOR PREVENTION OF DECUBITUS ULCERS offers a number of advantages as described in detail above.

Figure 13:
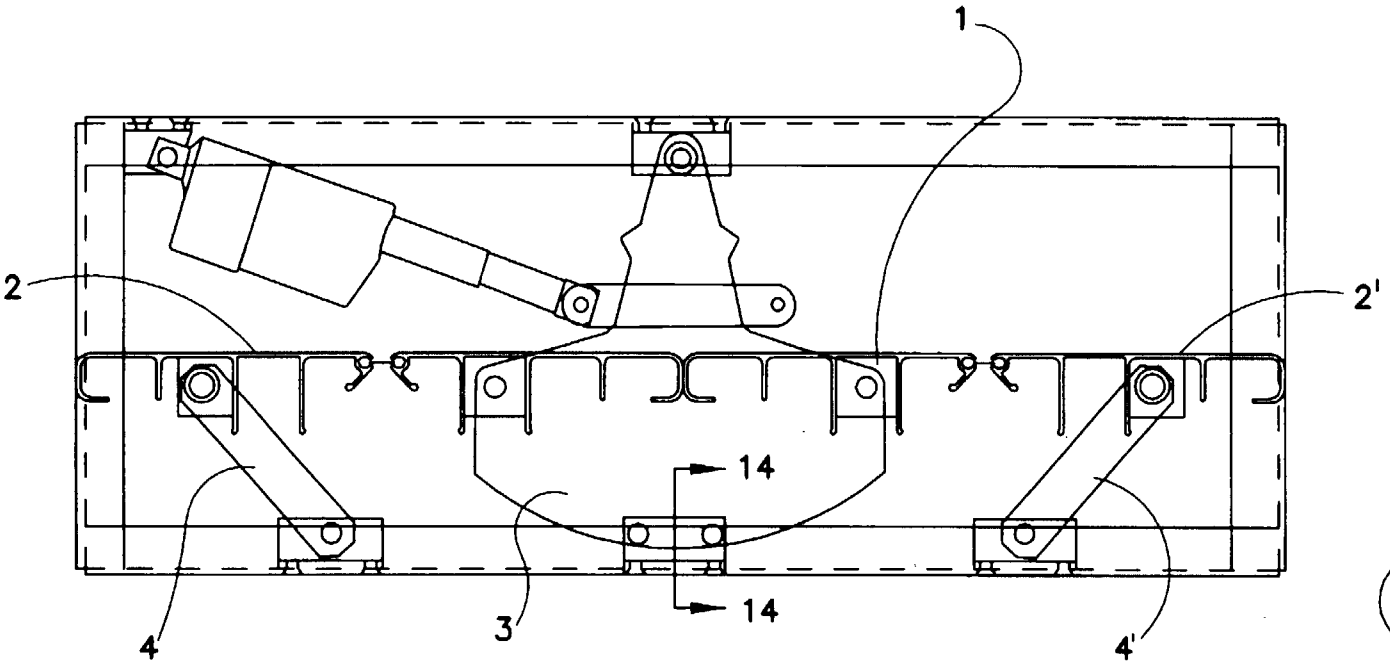
FIG. 13 illustrates an end view of an embodiment according to the present invention.

Referring to FIG. 13, bar linkage 3 can be extended so that it rotates between two fixed supports. By extending bar linkage 3 to rotate between two fixed supports in the bottom frame, physical competency and integrity of the structural section is enhanced.

Figure 14:
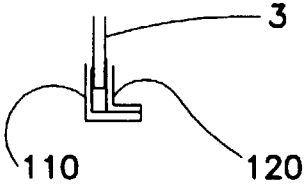
FIG. 14 illustrates a partial cross sectional view of the embodiment shown in FIG. 13.

Referring to FIG. 14, the central platen headboard bar linkage 3 can be seen to rotate about the headboard frame pivot point in an aligned position adjacent the headboard frame between a first parallel headboard support 110 and a second parallel headboard support 120. Similarly, the central platen footboard bar linkage can be constrained to rotate about the footboard frame pivot point in an aligned position adjacent the footboard frame between a first parallel footboard support and a second parallel footboard support.

Figure 15:
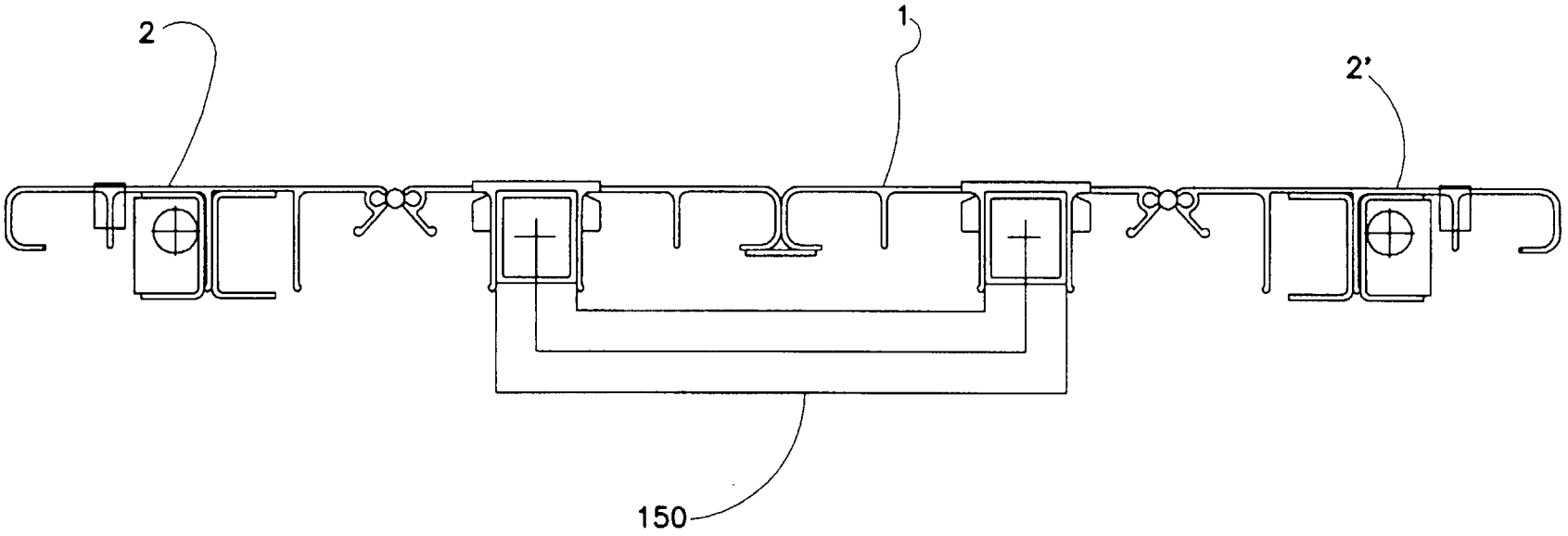
FIG. 15 illustrates a view of an embodiment according to the present invention.

Referring to FIG. 15, aluminum extrusions are used for as platen segments. Two segments can be joined back to back to form the center platen 1 and individually form side platens 2 and 2'.

Figure 16:
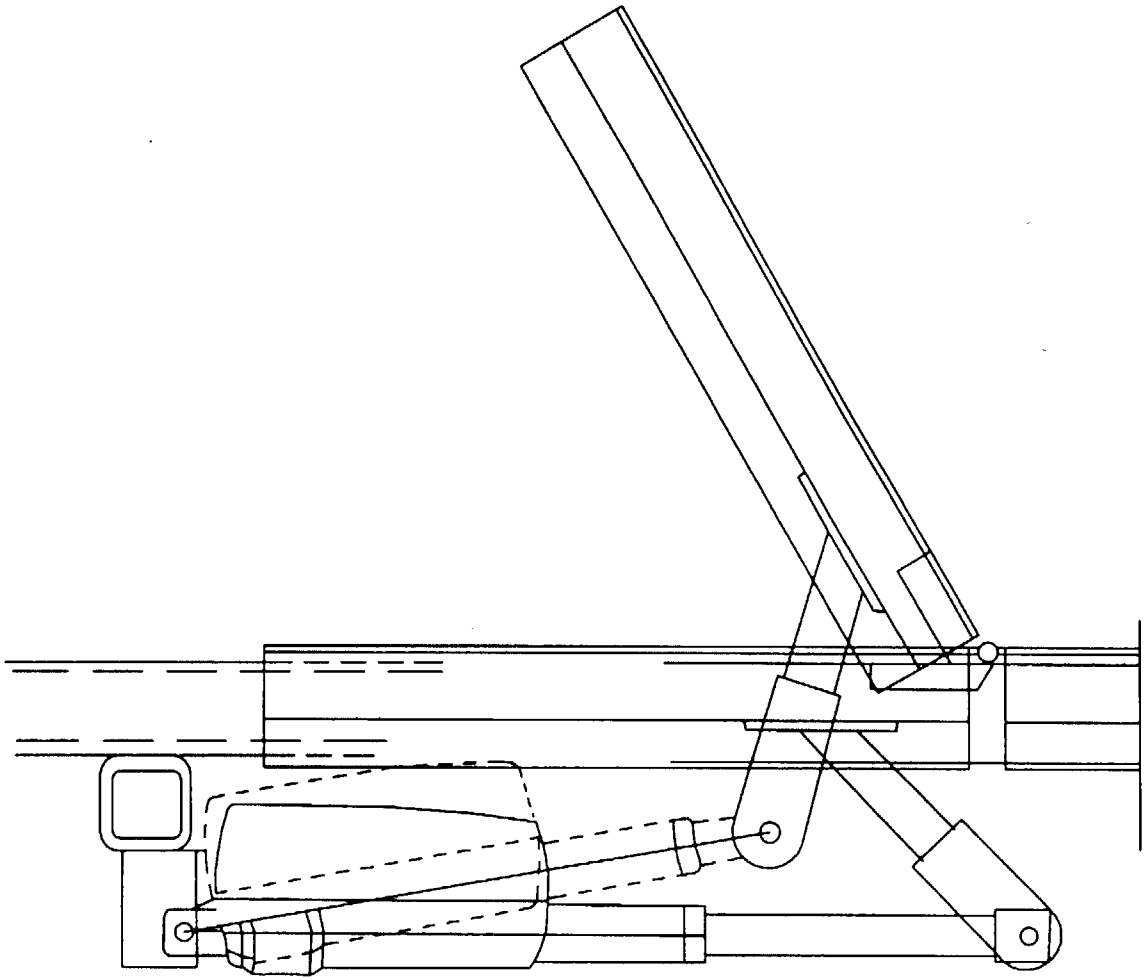
FIG. 16 illustrates a partial side view of a portion of an embodiment according to the present invention.

Referring to FIG. 16, the head gatch feature (raising the head of the patient) is shown. The platen sections are positioned in a flat position. In this embodiment, the platen are provided with a hinge that is across the other plain and perpendicular to the living hinge axis. The structures to support the bed are guided by the extruded legs of the platen sections.

Figure 17:
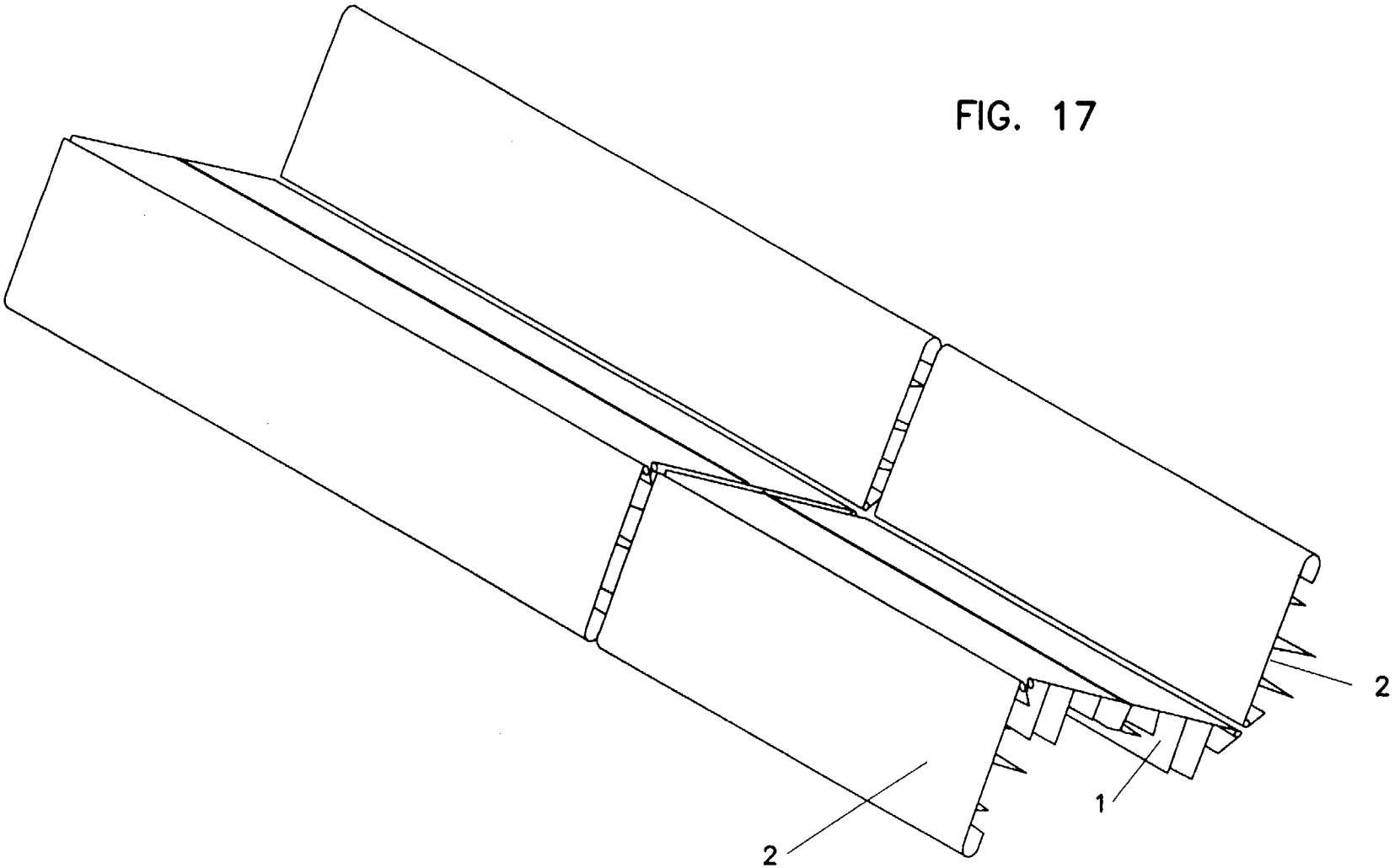
FIG. 17 illustrates a perspective view of a portion of an embodiment according to the present invention.

Referring to FIG. 17, no fixed sub frames are required. Further, no fixed structural side rails are required because of the inherent rigidity of the working parts which are all housed in the head and foot boards of the bed.

Figure 18:
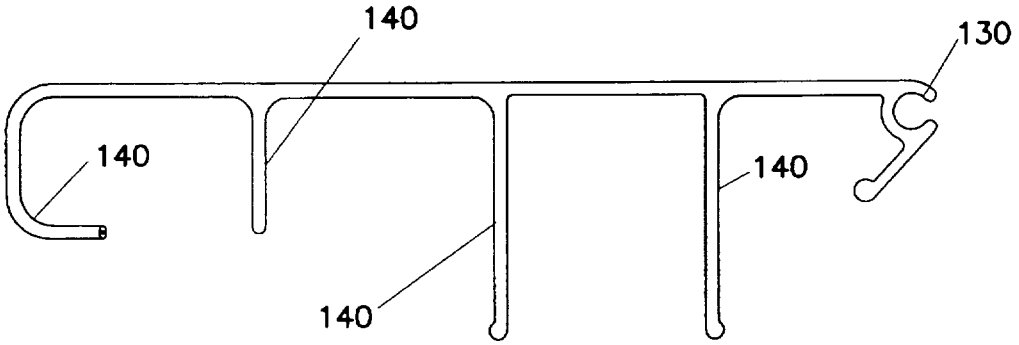
FIG. 18 illustrates an end view of a portion of an embodiment according to the present invention.

Referring to FIG. 18, a slot for a continuous polymeric "living hinge" 130 can be provided as an integral part of the platen extrusion. All of the support members for the platen sections are part of the extrusion. A single section will support 400 pounds in the middle of a 78" length.

Figure 19:
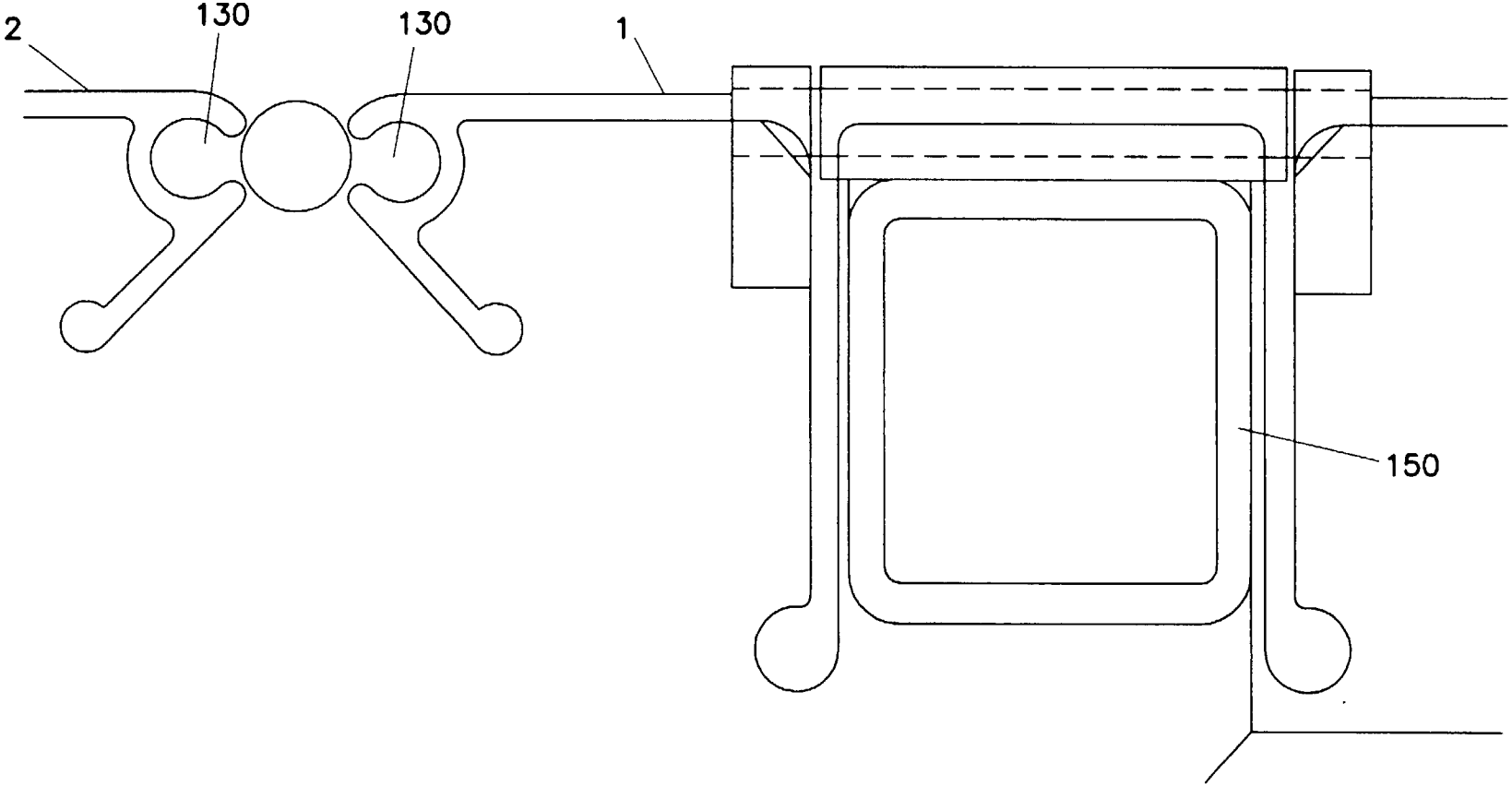
FIG. 19 illustrates an end view of a portion of an embodiment according to the present invention.

Referring to FIG. 19, the slot for the polymeric hinge 130 can be seen with greater detail. A sub frame for the platens can be provided if desired although it is not required.

Figure 20:
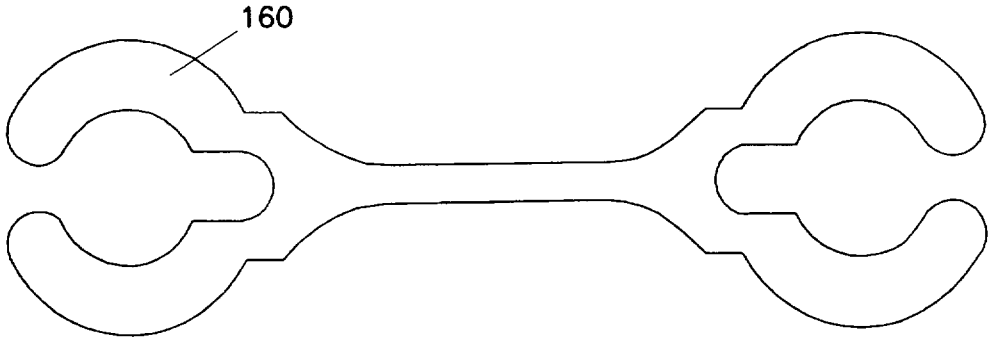
FIG. 20 illustrates an end view of a hinge according to the present invention.

Referring to FIG. 20, the continuous polymeric hinge 160 is custom designed and extruded for this application. It is easy to install and replace by merely sliding it into or out of the extruded slots 130. The continuous polymeric hinge 160 is very strong, has a long life, is absolutely silent, and never needs to be lubricated.

Figure 21:
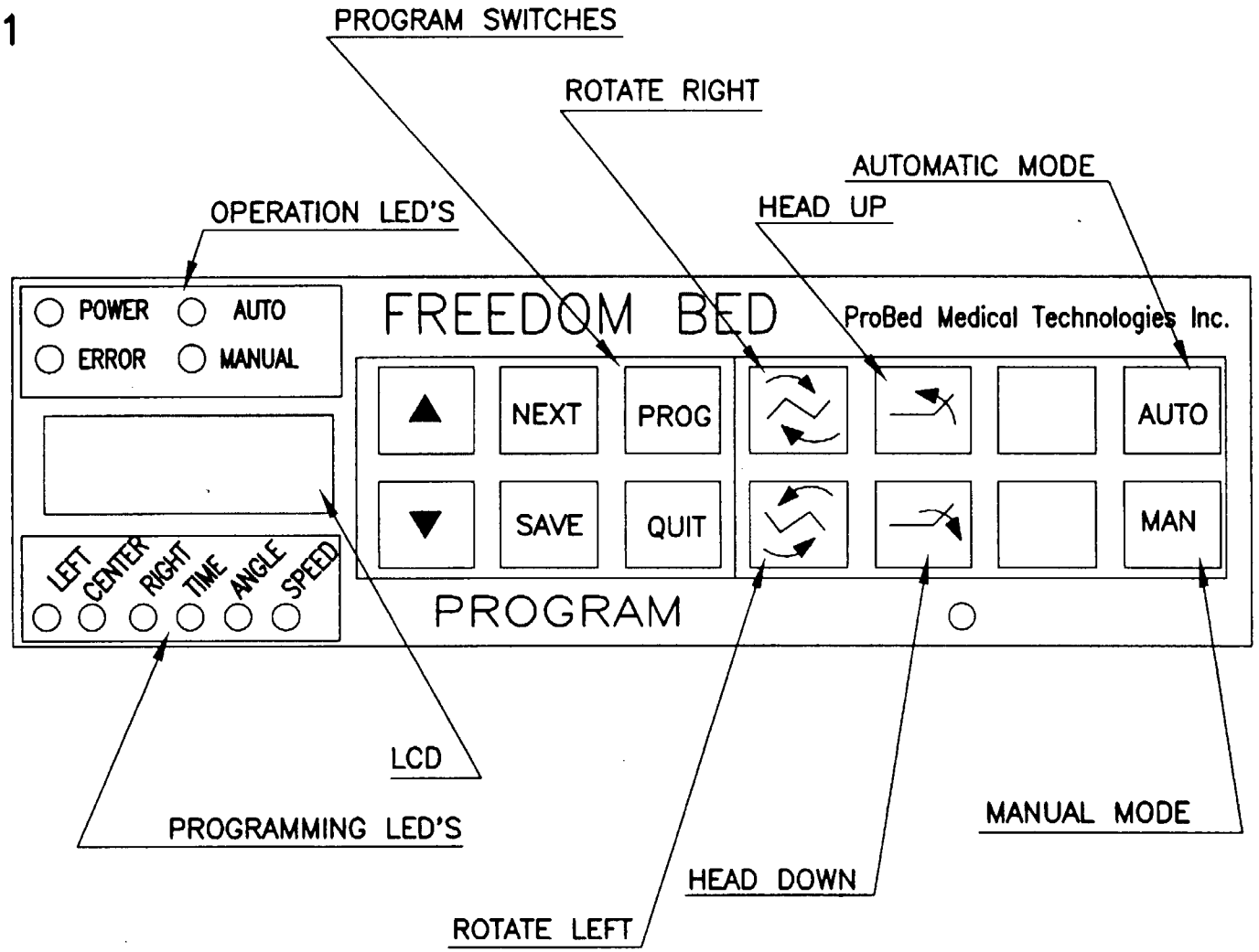
FIG. 21 illustrates an embodiment of a control panel according to the present invention.

Referring to FIG. 21, the present invention is the first computerized bed. Further, the present invention is the first computerized lateral turning bed. Furthermore, the present invention is the first computerized lateral turning bed equipped with a head gatch (head raising section).

Figure 22C:
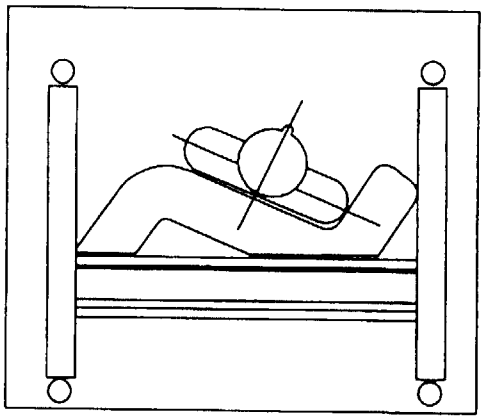
FIGS. 22A, 22B and 22C illustrate end views depicting the movement of the sections.
Figure 22B:
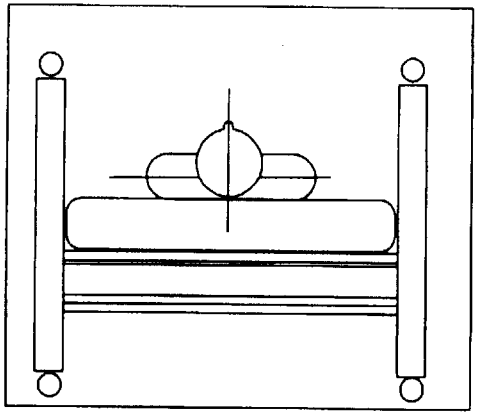
Figure 22A:
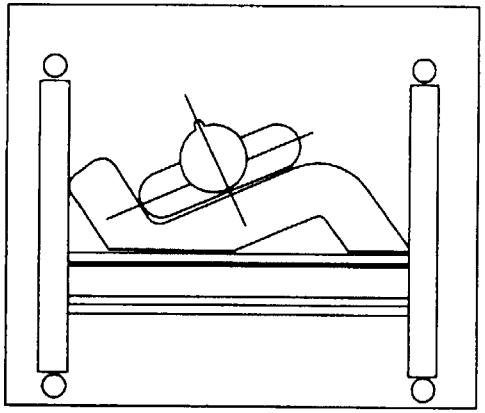

The foot board contains the microprocessor based main controller board. The actuators which control the rotational axis of the bed are located in the foot and head boards. These actuators are connected to the center section of the platen. This allows the center section to rotate plus or minus (±) 30 (thirty) degrees, while the appropriate outer section rotates up to support and contain the sleeper. This provides a surface to transfer weight onto, as well as prevents the user from falling out of the bed. The end views depicting the movement of the sections are illustrated in FIGS. 22A, 22B and 22C.

The control panel functions as the operator interface. It contains a micro controller which controls the LCD display, LED indicators, and the keypad. It connects to a motor control board via a serial communication link.

Figure 23:
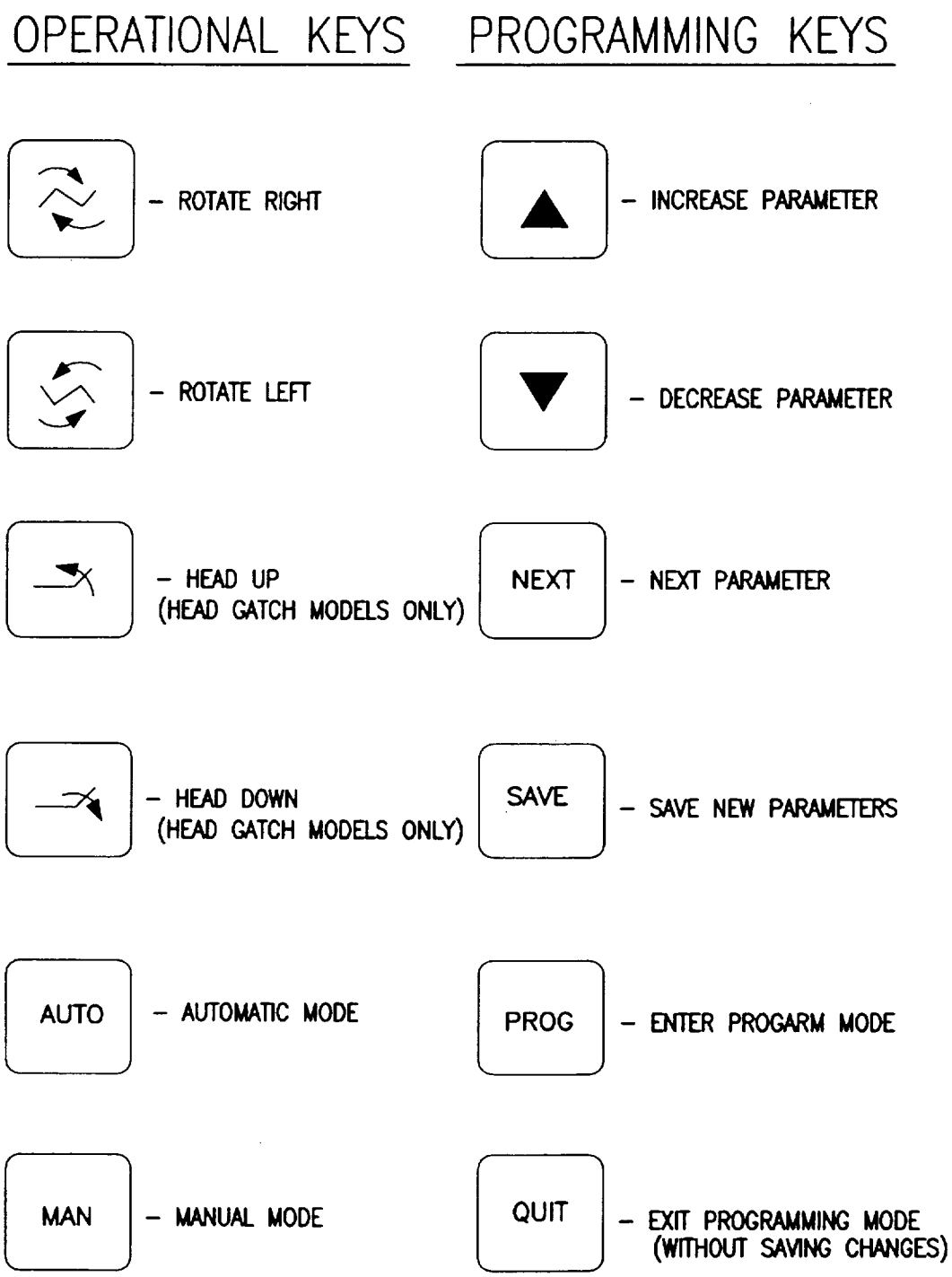
FIG. 23 illustrates the keys on the control panel shown in FIG. 21.
Figure 24A:
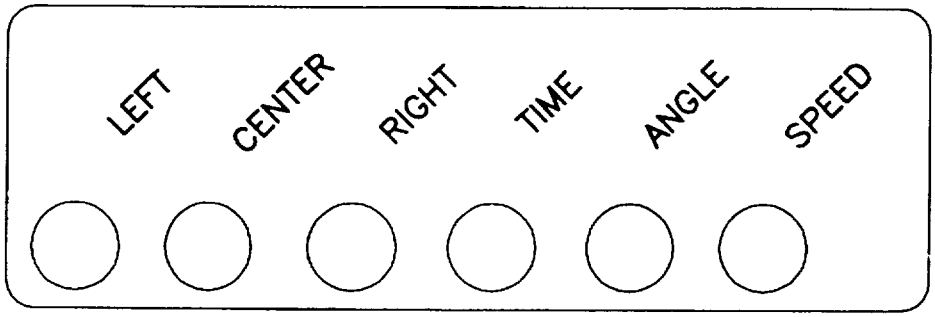
FIGS. 24A and 24B illustrate light emitting diodes on the control panel shown in FIG. 21.
Figure 24B:
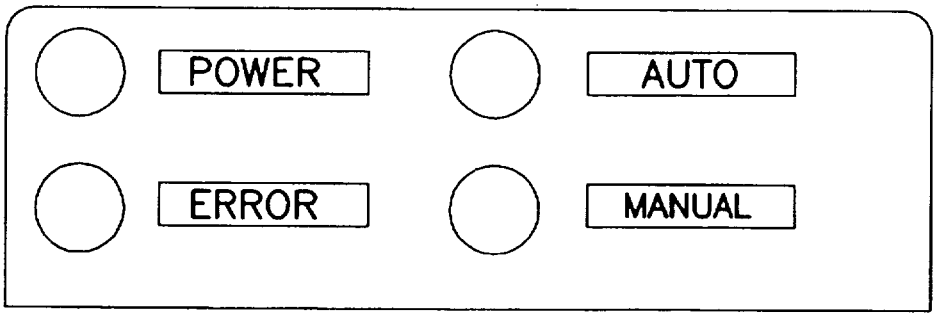

Referring to FIG. 23, the control panel keys have embedded snap dome switches for reliable and tactile operation. Each switch has an icon depicting its function. Referring to FIGS. 24A and 24B, there are LED's which light up depending on the mode of operation.

Referring again to FIGS. 1–4, as platen part 1-D' continues to rotate clockwise, platen part 2' can continue to rotate counterclockwise until an angle of up to 90 degrees forms at articulation point D' and platen part 2' and its relative mattress section 16' sufficiently supports the body at the steepest point of rotation to prevent skin shearing. This rotation can be controlled with a programmable microprocessor based controller and associated custom software and/or with the use of a single switch interface.

The present invention provides all of the requirements for the reduction and prevention of decubitus ulcers (bedsores) and increased overall health as long as some basic principles are understood and adhered to. The causes of bedsores can be eliminated in a simple manner. The secret is to mimic the body's natural tendency to move around while sleeping. Any catastrophic injury or any disease which reduces this motion can only have a negative effect upon overall health.

The present invention is equipped with a computer controller which will allow most users to achieve complete freedom from nighttime attendants, and a larger degree of independence. The mattress of the present invention articulates and thereby repositions the user onto a partial side laying position. Weight is redistributed from loaded areas to unloaded areas under a timed schedule which is completely programmable (time, angle and speed), and automatic.

The present invention looks like a normal bed, with a headboard, foot board and mattress. However, located under the mattress section is a frame (referred to as the platen) including three sections joined together with flexible joints.

The present invention is a 12 volt powered device and is supplied with its own separate power supply. This includes: a) a weatherproof box, b) a 12 volt sealed lead acid battery, c) a 12 volt, 1 amp smart charger, d) a 15 amp circuit breaker and e) an on/off switch. To operate the bed, plug the AC power wire into a wall socket. This powers the battery charger. Plug the 12 volt wire into the socket in the bottom channel of either the head or foot board, which ever is closest to the power supply. Turn the power switch to on. The power light on the control panel will light up. In the event of a power failure the battery backup will supply power to the bed for a period of 2 to 10 days depending on the frequency of turning.

The present invention is equipped with a manual operating mode. To enter the manual operating mode depress the "MAN" switch. This will set the front panel status to the following:

LCD: Blank
Auto LED: off
Manual LED: on
Error LED: (dependent on error conditions)
Power LED: on In the manual mode, the operation of the bed is controlled by the rotate right and rotate left switches on the front panel. The rotational switches are used to rotate the bed left or right a full speed. The controller will stop operation of the actuator when the switch is released or until a limit switch is activated.

The present invention is equipped with an automatic operating mode. To enter the automatic operating mode depress the "AUTO" switch. This command will start the auto mode. This will set the front panel status to the following:

LCD: remaining time before next action
Auto LED: on
Manual LED: off
Error LED: (dependent on error conditions)
Power LED: on The bed is then controlled automatically according to the current operational parameters. The parameters are explained in more detail in the section on programming operation. In automatic mode, the bed movement switches (i.e., rotate left, rotate right) are not functional. Depressing either of these switches in the automatic mode will not product a response.

When the automatic mode is entered, the control algorithm will be initiated from the current position of the bed. For example, if the bed has been manually rotated to any position to the left, the control algorithm will start at the Left Dwell Point. The programming switches will be active, and any parameters which are modified and saved while in the automatic mode will be effective immediately.

PROGRAMMING OPERATION

Programming of the various parameters is accomplished by using the switches, LED's and LCD display as outlined below. There is a visible LED with text on the Control Panel for each parameter which can be modified by the operator. For the purpose of operating the present invention, the left and right angles are determined to be the side that the user is rotated to, with the user's feet at the control panel end. The list of parameters follows.

Left Dwell: this is the period of time which the bed remains at the left angle position. This period is adjustable from 0 minutes to 4:00 hours.

Center Dwell: this is the period of time which the bed remains at the center (flat) position. Similarly, this period of time is adjustable from 0 minutes to 4:00 hours.

Right Dwell: this is the period of time which the bed remains at the right angle position. Again, this period of time is adjustable from 0 minutes to 4:00 hours.

Left Angle: this is the angle to which the bed will rotate to in the left position. It is adjustable from 1 degree to 30 degrees.

Right Angle: this is the angle to which the bed will rotate to in the right position. Similarly, it is adjustable from 1 degree to 30 degrees.

Speed: this is the relative speed at which the bed will rotate. It is adjustable from 15% to 100%.

The switches that are used for carrying out the programming operation include:

PROG: Enters the Programming mode;

Up Arrow: Increases the value of the parameter;

Down Arrow: Decreases the value of the parameter;

Next: selects the next parameter;

Save: saves the new parameters; and

Quit: cancels the programming mode without saving changes.

The programming mode can be initiated at any time. All of the other operational switches will remain active when the programming mode has started.

The programming mode is initiated by pressing the "PROG" switch, and holding for 3 seconds. The left dwell parameter and time LEDs will light up, and the LCD display will show the current value of this parameter. The operator can then use the up arrow to increase the parameter or the down arrow to decrease the parameter.

Pressing the "Next" switch will then cycle the operator to the center dwell parameter, and the center and time LEDs will light up. Again, the LCD display will show the existing value of the parameter.

The operator can then cycle through all of the parameters in similar fashion by pressing the "Next" switch. When the last parameter (i.e., speed) is being displayed, the subsequent operation of the "Next" switch will cycle back to the left parameter.

The operator can exit from the programming mode at any time by pressing either the "Save" switch or the "Quit" switch. The "Save" switch will save the updated parameters into EPROM for future use. The "Quit" switch will end the programming mode without saving any modifications to the parameters.

After finishing the programming, all parameter LEDs will be off. If the operator exits programming in the manual mode, then the LCD will be blank. Alternatively, if the operator exits programming in the automatic mode, then the LCD will show the time remaining in the current position.

The user should not be transferred onto, or off of, the bed unless the bed is level and the controller is off or in the manual mode.

This improved articulating bed design utilizes pulse width modulation to determine rotational speed and position. The actuator is servo controlled by the microprocessor to allow for controllable rotational speed under varying load conditions as the body is turned. Setting the timer to "O" dwell time for any one position will cause the controller to move the platen in such a way as to by-pass that position. The acceleration and the maximum speeds are adjustable. Under program control, the platen will "soft" start and "soft" stop to reduce inertial jarring of the user. The end angle in the two side laying positions is adjustable by two controls.

Numerous modifications and variations are possible in addition to those specifically described above. Accordingly, the scope of the present invention is defined only by the following appended claims.

For example, there are alternative drive possibilities for actuating the dynamic portions of the bed. One such alternative is placing a gear segment on the bottom of element 3 and mounting a worm gear and a small drive motor in the guide at the bottom of the frame.

The foregoing descriptions of preferred embodiments are provided by way of illustration. Practice of the present invention is not limited thereto and variations therefrom will be readily apparent to the skilled without deviating from the spirit of the present invention.

While there is shown and described herein certain specific combinations embodying this invention for the purpose of clarity of understanding, the same is to be considered as illustrative in character, it being understood that only preferred embodiments have been shown and described. It will be manifest to those skilled in the art that certain changes, various modifications and rearrangements of the parts may be made without departing from the spirit and scope of the underlying inventive concept and that the same is not limited to the particular forms herein shown and described except insofar as indicated in the scope of the appended claims.

The entirety of everything cited above or below is expressly incorporated herein by reference.

What is claimed is:

1. An articulated bed comprising:

a central platen comprising a headboard end, a footboard end, a first side platen edge and a second side platen edge;

a headboard frame pivotally connected to the headboard end of the central platen at a headboard frame pivot point with a central platen headboard bar linkage;

a footboard frame pivotally connected to the footboard end of the central platen at a footboard frame pivot point with a central platen footboard bar linkage;

a first side platen hinged to the first side platen edge of the central platen, connected to the headboard frame with a first side platen headboard bar linkage and connected to the footboard frame with a first side platen footboard bar linkage;

a second side platen hinged to second side platen edge of the central platen, connected to the headboard frame with a second side platen headboard bar linkage and connected to the footboard frame with a second side platen footboard bar linkage; and means for articulating at least one of the central platen headboard bar linkage and the central platen footboard bar linkage.

2. The apparatus of claim 1 wherein the central platen headboard bar linkage rotates about the headboard frame pivot point in an aligned position adjacent the headboard frame between a first parallel headboard support and a second parallel headboard support.

3. The apparatus of claim 1 wherein the central platen foot board bar linkage rotates about the footboard frame pivot point in an aligned position adjacent the footboard frame between a first parallel footboard support and a second parallel footboard support.

4. The apparatus of claim 1 wherein the first side platen is continuously hinged to the first side platen edge of the central platen with a continuous polymeric hinge and the second side platen is continuously hinged to the second side platen edge of the central platen with a continuous polymeric hinge.

5. The apparatus of claim 1 further comprising a programmable microprocessor based controller.

6. The apparatus of claim 5 wherein said programmable microprocessor based controller controls said apparatus based on a set of variables, said set of variable comprising:

a left dwell period of time during which the apparatus remains at a left angle position, a center dwell period of time during which the apparatus remains at a center position, a right dwell period of time during which the apparatus remains at a right angle position, a left angle which determines the left angle position, a right angle which determines the right angle position, and speed.

7. The apparatus of claim 6 further comprising a separate power supply comprising:

a weatherproof box;

a 12 volt sealed lead acid battery;

a 12 volt, 1 amp, smart charger;

a 15 amp circuit breaker; and an on/off switch.

8. An apparatus comprising:

a central platen comprising a proximal end, a distal end, a first side platen edge and a second side platen edge;

a first frame pivotally connected to the proximal end of the central platen with a central platen proximal bar linkage;

a second frame pivotally connected to the distal end of the central platen with a central platen distal bar linkage;

a first side platen hinged to the first side platen edge of the central platen, connected to the first frame with a first side platen proximal bar linkage and connected to the second frame with a first side platen distal bar linkage;

a second side platen hinged to the second side platen edge of the central platen, connected to the proximal frame with a second side platen proximal bar linkage and connected to the second frame with a second side platen distal bar linkage; and means for articulating at least one of the central platen proximal bar linkage and the central platen distal bar linkage.

* * * * *